US011148252B2

(12) United States Patent
Vega et al.

(10) Patent No.: US 11,148,252 B2
(45) Date of Patent: Oct. 19, 2021

(54) CARBON DIOXIDE CLEANING SYSTEM WITH SPECIALIZED DISPENSING HEAD

(71) Applicant: Reliabotics LLC, New Brunswick, NJ (US)

(72) Inventors: Juan Vega, New Brunswick, NJ (US); Ahsan Anwar, New Brunswick, NJ (US); Alexander Michalski, New Brunswick, NJ (US)

(73) Assignee: Reliabotics LLC, New Brunswick, NJ (US)

( * ) Notice: Subject to any disclaimer, the term of this patent is extended or adjusted under 35 U.S.C. 154(b) by 335 days.

(21) Appl. No.: 16/352,318

(22) Filed: Mar. 13, 2019

(65) Prior Publication Data

US 2019/0283211 A1 Sep. 19, 2019

Related U.S. Application Data

(60) Provisional application No. 62/642,939, filed on Mar. 14, 2018.

(51) Int. Cl.

| | |
|---|---|
| ***B24C 1/00*** | (2006.01) |
| ***B24C 7/00*** | (2006.01) |
| ***B08B 5/02*** | (2006.01) |
| *B24C 5/04* | (2006.01) |

(52) U.S. Cl.

CPC ..... *B24C 1/003* (2013.01); *B08B 5/02* (2013.01); *B24C 7/0046* (2013.01); *B24C 5/04* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,173,916 | B1 * | 1/2001 | Krone-Schmidt | C01B 32/55 239/590.3 |
| 6,442,980 | B2 | 9/2002 | Preston et al. | |
| 7,293,570 | B2 | 11/2007 | Jackson | |
| 9,221,067 | B2 | 12/2015 | Jackson et al. | |
| 2006/0124156 | A1 * | 6/2006 | Jackson | B24C 11/005 134/99.1 |
| 2018/0304317 | A1 * | 10/2018 | Cho | B08B 7/0021 |

FOREIGN PATENT DOCUMENTS

| | | | | |
|---|---|---|---|---|
| WO | WO2017/003024 | * | 1/2017 | B08B 11/00 |

* cited by examiner

*Primary Examiner* — Erin F Bergner
(74) *Attorney, Agent, or Firm* — LaMorte & Associates PC

(57) ABSTRACT

A cleaning system that utilizes a dispensing head to spray carbon dioxide and a propellant against a surface. The carbon dioxide being propelled includes solid phase crystals. A supply line is used to feed the carbon dioxide to a dispensing head. Within the dispensing head, a first manifold chamber receives the carbon dioxide. A plurality of pathways link the first manifold chamber to a plurality of output nozzles. Each of the pathways contains an internal configuration that induces a formation of solid phase carbon dioxide crystals as the carbon dioxide from the supply line flows through the pathways toward the output nozzles. The propellant enters the dispensing head and flows into a second manifold chamber. The second manifold chamber has an exit opening near, or at, the output nozzles. As carbon dioxide, in both gas and solid phase, exits the output nozzles, it is accelerated by the propellant.

15 Claims, 7 Drawing Sheets

CARBON DIOXIDE CLEANING SYSTEM WITH SPECIALIZED DISPENSING HEAD

RELATED APPLICATIONS

This application claims the benefit of provisional patent application No. 62/642,939, filed Mar. 14, 2018.

BACKGROUND OF THE INVENTION

1. Field of the Invention

In general, the present invention relates to cleaning systems that are designed to clean with cryogenic fluid, such as carbon dioxide. More particularly, the present invention relates to the design and structural elements of dispensing heads that are used to direct cryogenic fluids toward various objects being cleaned.

2. Prior Art Description

In industry, many raw materials and parts must be cleaned before they can be used to make products. Likewise, many finished products must be cleaned before being packaged and shipped. Cleaning such parts and assemblies seems simple, but is actually one of the most administratively difficult processes performed in a factory. If a part is cleaned using water and solvents, then the dirty waste water is considered to be polluted waste water. The waste water must then be either cleaned and/or disposed of as industrial waste. Both options are expensive and require complex paperwork filings with federal, state and local environmental authorities. Likewise, if liquid solvents, such as petroleum solvents, are used for cleaning in place of water, then the dirty solvents are considered toxic waste and must be recycled and/or disposed of as toxic waste.

Recognizing the many downsides of using water and other liquid solvents to clean parts, manufacturers have resorted to cleaning technologies that leave behind no liquid waste. Some parts can be cleaned simply by blowing air against the part. This works for dust contamination. However, surface stains, oil contamination and the like are not readily removed with forced air. A more practical solution is to clean parts with a cryogenic fluid, such as carbon dioxide, that dissipates into the atmosphere after performing its cleaning function. Carbon dioxide is a preferred cryogenic liquid, because it is plentiful, inexpensive, easy to store, and is mostly unregulated in its use.

Carbon dioxide is a good solvent. As such, when projected against a dirty surface, carbon dioxide has the ability to dissolve many contaminants that would be unaffected by air. It has also been learned that if crystals of solid phase carbon dioxide are projected against a surface, then the impact of the crystals on a surface greatly increases the cleaning effectiveness of the carbon dioxide. Prior art cryogenic cleaning systems that clean with crystals of carbon dioxide are exemplified by U.S. Pat. No. 6,442,980 to Preston and U.S. Pat. No. 9,221,067 to Jackson.

One of the primary problems associated with cleaning systems that clean with crystals of solid phase carbon dioxide is the difficulty in forming crystals within the propelled stream of carbon dioxide. The creation of crystals in current commercial systems, requires the use of complex discharge nozzles. Such prior art discharge nozzles are exemplified by U.S. Pat. No. 7,293,570 to Jackson. The use of such nozzles requires direct feed to a pressurized cryogenic supply. Accordingly, if multiple nozzles are arranged in a matrix to form a cleaning head, then multiple supply lines have to extend to the cleaning head.

In industry, it will be understood that it would be beneficial to provide large cleaning heads that contain multiple discharge nozzles. In this manner, large areas of a part or product can be cleaned with one pass of the cleaning head. It will also be understood, that in many industrial applications, it would be beneficial to place a cleaning head on a robot arm or some other moving piece of automation that would move the cleaning head along a surface in need of cleaning. However, since the cleaning head contains multiple nozzles and has multiple supply lines for the nozzles, the practical ability to automate the movements of the cleaning head become limited and inefficient. For example, if the cleaning head is placed at the end of a robot arm, the robot arm can only move in limited ways or the robot arm will quickly twist and damage the multiple supply lines. Likewise, if a robot arm moves a cleaning head through a complex path, the robot arm must retrace the complex path in reverse in order not to twist and tangle the multiple supply lines.

A need therefore exists for an improved dispensing head for a carbon dioxide cleaning system that contains multiple spray nozzles, yet is capable of producing solid phase crystals at all spray nozzles while utilizing only a limited number of carbon dioxide supply lines. This need is met by the present invention as described and claimed below.

SUMMARY OF THE INVENTION

The present invention is a cleaning system that utilizes a dispensing head to spray carbon dioxide and a propellant against a surface that is being cleaned. The carbon dioxide being propelled includes solid phase crystals that physically impact the surface being cleaned and dislodge contamination.

The system operates using a supply of liquid carbon dioxide and a supply of propellant gas. A minimum of supply lines is used to feed the carbon dioxide to a dispensing head. Within the dispensing head, a first manifold chamber receives the carbon dioxide from the supply line. A plurality of pathways links the first manifold chamber to a plurality of output nozzles. Each of the pathways contains an internal configuration that induces a formation of solid phase carbon dioxide crystals as the carbon dioxide from the supply line flows through the pathways toward the output nozzles.

The propellant enters the dispensing head and flows into a second manifold chamber. The second manifold chamber has an exit opening near, or at, the output nozzles. As carbon dioxide, in both gas phase and solid phase, exits the output nozzles, it is accelerated forward by the propellant. The carbon dioxide is directed toward a surface to be cleaned. After contacting the surface and displacing or dissolving contaminants, the carbon dioxide diffuses into the ambient atmosphere.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention cleaning system and dispensing head can be used in many cleaning applications, the present invention is particularly well suited for use in complex cleaning applications where a cleaning head is moved through a complex path while performing the cleaning task. As such, the exemplary embodiment of the present invention shows a system where a dispensing head is positioned at the end of an articulating robotic arm. Furthermore, the dispensing head is shown with a matrix of nozzles that are linearly aligned. It will be understood that such embodiments are exemplary and are selected in order to set forth some of the best modes contemplated for the invention. The illustrated embodiments, however, should not be considered limitations when interpreting the scope of the appended claims.

Figure 1:
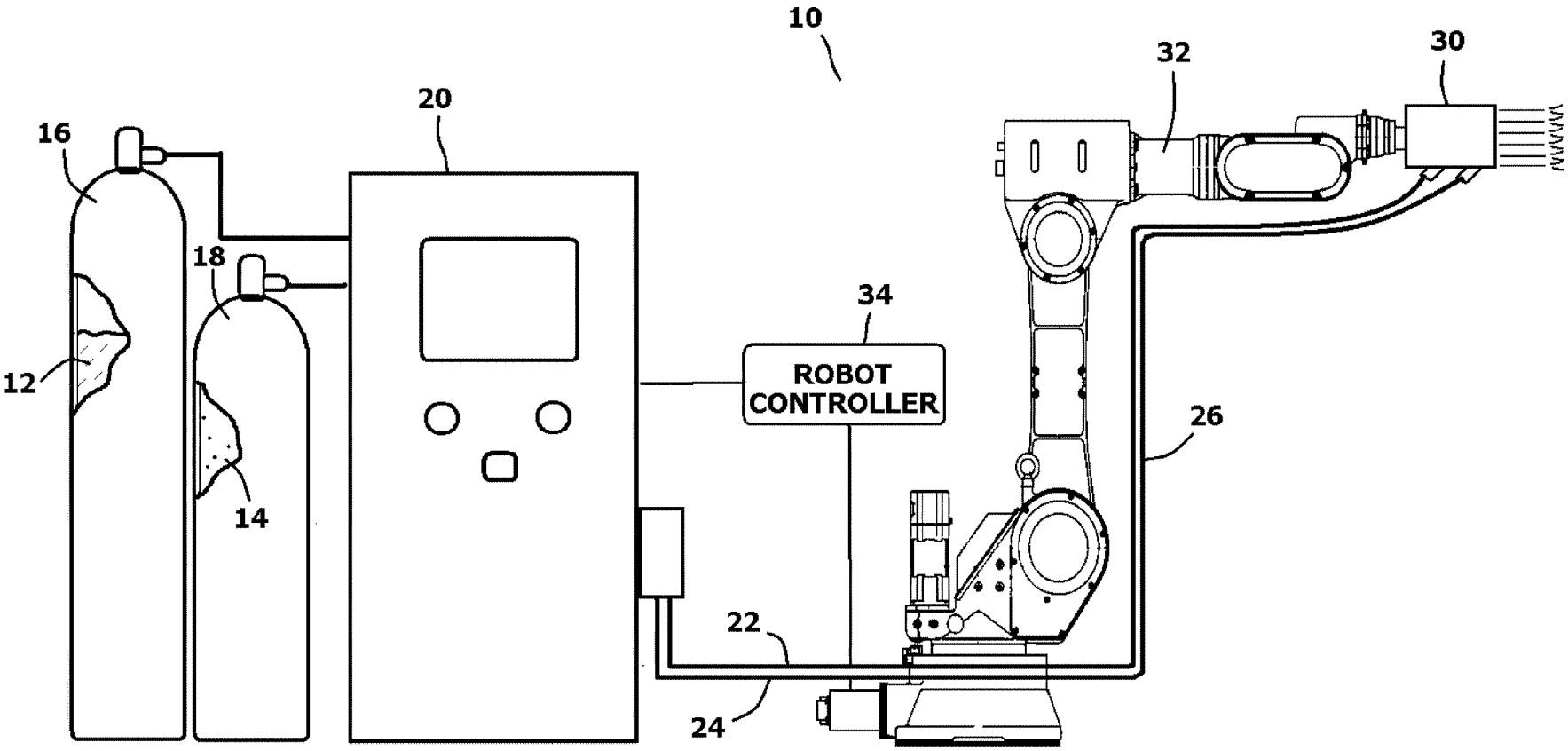
FIG. 1 shows a first exemplary embodiment of the present invention cleaning system.

Referring to FIG. 1, the overall cleaning system 10 is shown. The cleaning system 10 cleans with carbon dioxide 12 and a propellant 14. The propellant 14 can be a mixture of gases, such as compressed air. However, in certain applications that are oxygen sensitive, the propellant 14 can be compressed nitrogen or a noble gas, such as argon. The carbon dioxide 12 is stored in one or more supply tanks 16 that maintain the carbon dioxide 12 mostly as a liquid at ambient temperatures. The propellant 14 can be stored in a secondary supply tank 18 or can be created on demand by a compressor, provided the propellant 14 is compressed air.

A control unit 20 is provided that receives the carbon dioxide 12 and the propellant 14. The control unit 20 is programmable and selectively regulates the pressure, volume and duration of the carbon dioxide 12 and the propellant 14 being supplied for a given cleaning task. The control unit 20 has at least two output lines. The two output lines include a regulated carbon dioxide line 22 and a regulated propellant line 24. Both the carbon dioxide line 22 and the propellant line 24 are bundled into a supply cable 26 that extends from the control unit 20 to a dispensing head 30. It will be understood that in some applications where high flow rates are required. More than one regulated carbon dioxide line 22 and more than one regulated propellant line 24 can be bundled within the supply cable.

The dispensing head 30 can be affixed to any piece of articulated equipment. In the shown embodiment, the dispensing head 30 is affixed to a robotic arm 32. The robotic arm 32 has a programmable controller 34 that regulates the repeating movements of the robotic arm 32. The programmable controller 34 of the robotic arm 32 can communicate with the control unit 20 of the cleaning system 10 to ensure that the carbon dioxide 12 and the propellant 14 are only released at the appropriate moments during the cycled movement of the robotic arm 32.

Figure 2:
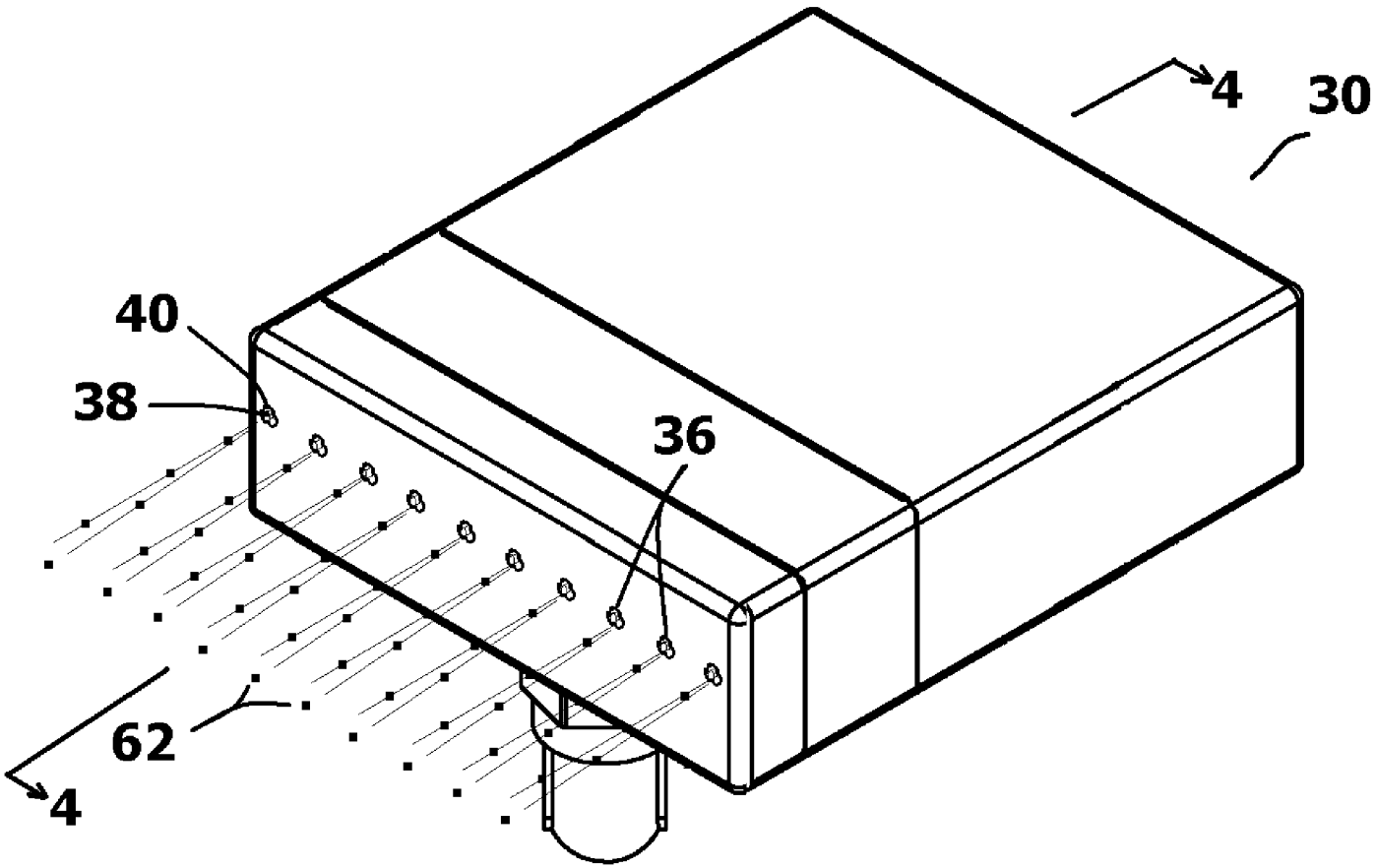
FIG. 2 shows an exemplary embodiment of a dispensing head for use in the cleaning system.
Figure 3:
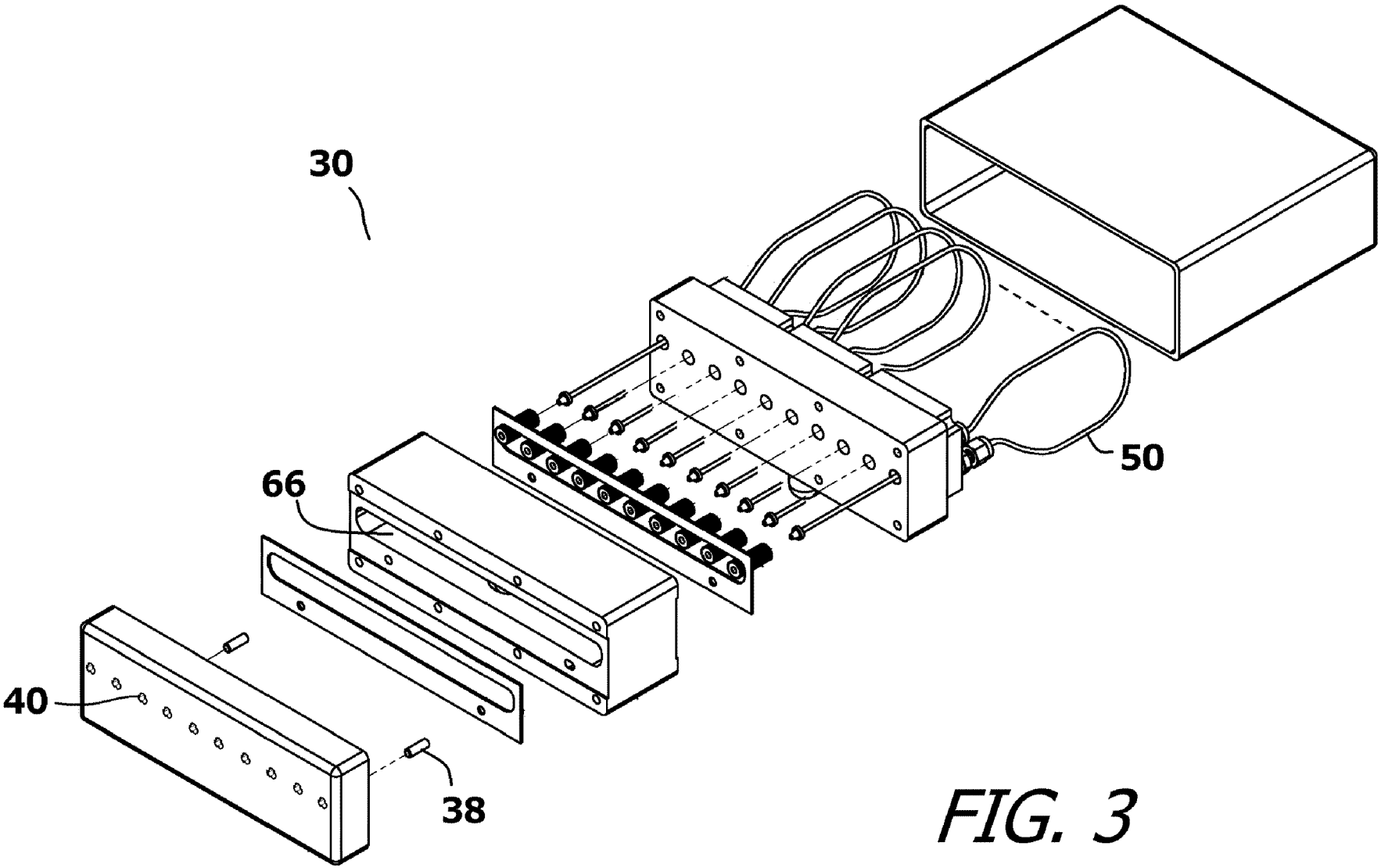
FIG. 3 shows an exploded view of the embodiment of FIG. 2.
Figure 4:
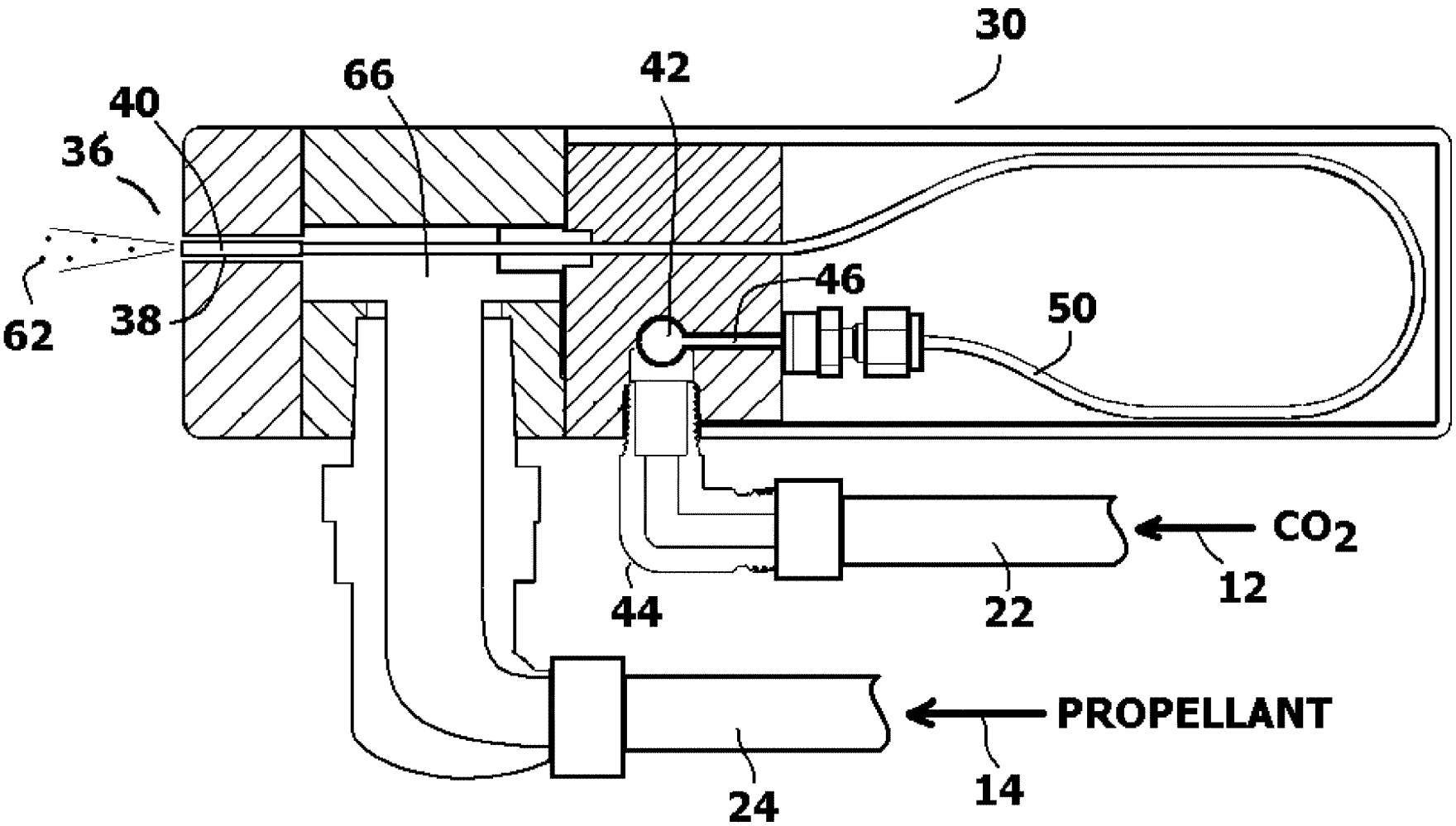
FIG. 4 shows a cross-sectional view of the dispensing head shown in FIG. 2, viewed along section line 4-4.

Referring to FIG. 2, FIG. 3 and FIG. 4 in conjunction with FIG. 1, it can be seen that the dispensing head 30 contains a matrix of output nozzles 36. In the shown embodiment, the output nozzles 36 are linearly aligned. However, it will be understood that the output nozzles 36 can be set in multiple rows or in specialized patterns, such as a circular pattern, for specific cleaning operations. Regardless of its position, each output nozzle 36 has an inner tube 38 surrounded by a concentric propellant opening 40. The inner tube 38 discharges carbon dioxide 12 in both gas phase and solid phase. The propellant opening 40 discharges the propellant 14 as a gas.

Within the dispensing head 30, there is a $CO_2$ manifold chamber 42. The $CO_2$ manifold chamber 42 is directly coupled to the carbon dioxide supply line 22 and is filled with carbon dioxide 12 at the pressure and flow volume rate provided through the control unit 20. As such, the carbon dioxide 12 is mostly liquid, being that it is at a temperature and pressure that is in the liquid state of carbon dioxide. The liquid carbon dioxide 12 is received into the $CO_2$ manifold chamber 42 through an input coupling 44.

Figure 5:
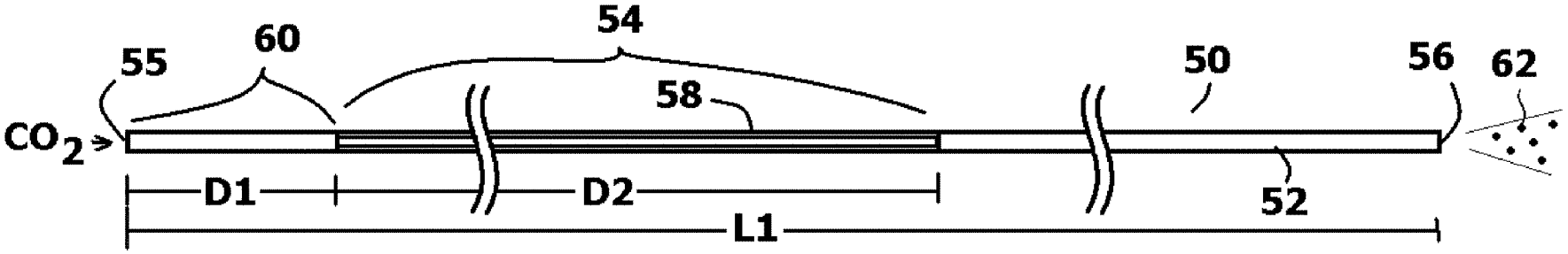
FIG. 5 shows a cross-sectional view of a capillary tube used within the dispensing head of FIG. 2.

A plurality of small exit openings 46 are formed in the $CO_2$ manifold chamber 42. The number of exit openings 46 equals the number of output nozzles 36 supported by the dispensing head 30. Referring to FIG. 5 in conjunction with FIG. 3 and FIG. 4, it can be seen that capillary tube assemblies 50 connect each of the exit openings 46 to the inner tubes 38 within each of the output nozzles 36. The capillary tube assemblies 50 transport the carbon dioxide 12 from the $CO_2$ manifold chamber 42 to the output nozzles 36. However, the capillary tube assemblies 50 are specifically designed to induce crystal formation within the flowing carbon dioxide 12 as it travels from the $CO_2$ manifold chamber 42 to each output nozzle 36. Each capillary tube assembly 50 has an overall preferred length L1 of between five inches and twenty inches. Each capillary tube assembly 50 is an assembly of a primary tube 52 and a flow restrictor 54. The primary tube 52 has an inner diameter of between 0.02 inches and 0.05 inches, with a preferred inner diameter of 0.03125 (1/32) inches. The primary tube 52 has a first end 55 and an opposite second end 56, wherein the first end 55 connects to the $CO_2$ manifold chamber 42 and the second end 56 connects to the inner tube 38 of the output nozzle 36. However, within the primary tube 52 there is a flow restrictor 54. The flow restrictor 54 reduces the inner diameter to a smaller second diameter. The second smaller diameter is between 0.005 inches and 0.01 inches, with a preferred inner diameter of 0.007 inches. The flow restrictor 54 begins a first distance from the first end 55 of the capillary tube assembly 50. That first distance D1 is preferably between five percent and fifteen percent of the overall length of the capillary tube assembly 50. The flow restrictor 54 itself extends a second distance. The second distance D2 is preferably between one third and one half the overall length of the capillary tube assembly 50. The flow restrictor 54 can be fabricated in many ways. In a preferred assembly, the flow restrictor 54 is a length of smaller tube 58 that is inserted into the primary tube 52 and is affixed in place.

As carbon dioxide 12 enters the capillary tube assembly 50, it is compressed with a corresponding increase in pressure. The carbon dioxide advances through a short first section 60 between the first end 54 of the primary tube 52 and the flow restrictor 54. The carbon dioxide 12 then encounters the flow restrictor 54. As the carbon dioxide enters the flow restrictor 54 it is further compressed with a corresponding increase in pressure. As the carbon dioxide 12 enters the region of the flow restrictor 54, the pressure increases in proportion to the decrease in area. This causes the carbon dioxide 12 to experience a temperature and pressure that is conducive to the formation of solid-phase crystals. Due to throttling and the Joule-Thompson process, when the carbon dioxide exits the flow restrictor 54, the pressure and temperature of the carbon dioxide decreases rapidly as the gas expands. The changes in temperature and pressure produces an aerosol composition that contains many crystals 62 of solid phase carbon dioxide. The crystals 62 of solid phase carbon dioxide form just as the carbon dioxide exits the flow restrictor 54. As the carbon dioxide 12 exits the flow restrictor 54 and heads for the second end 56 of the primary tube 52, the pressure and temperature are such that the crystals 62 of solid phase carbon dioxide remain viable as the crystals 62 flow out of the capillary tube assembly 50. Additionally, as the pressure decreases upon exiting the flow restrictor 54, small segments of the crystals 62 of solid phase carbon dioxide interact. This causes some crystals 62 of solid phase carbon dioxide to clump together, therein creating larger crystals 62 of solid phase carbon dioxide.

Referring back to FIG. 4 in conjunction with FIG. 3 and FIG. 2, it can be seen that within the dispensing head 30, a propellant manifold chamber 66 is provided that is isolated from the $CO_2$ manifold chamber 42. The propellant manifold chamber 66 receives propellant 14 from the propellant supply line 24. The propellant openings 40 provide access to the propellant manifold chamber 66. The inner tubes 38 extends into the propellant openings 40, therein forming the output nozzles 36. Simultaneously, the pressurized propellant 14 is fed into the propellant manifold chamber 66. The propellant 14 escapes the propellant manifold chamber 66 through the propellant openings 40 surrounding the inner tube 38. The escaping propellant 14 accelerates the solid phase crystals 62 of carbon dioxide forward. This causes the solid phase crystals 62 of carbon dioxide to strike a target surface in front of the dispensing head 30 before the carbon dioxide sublimates into the ambient atmosphere.

When needed for cleaning, the carbon dioxide 12 is fed through a single carbon dioxide supply line 22 to the dispensing head 30. In the dispensing head 30, the carbon dioxide 12 enters a $CO_2$ manifold chamber 42 and is fed into a plurality of capillary tube assemblies 50. In the capillary tube assemblies 50, the carbon dioxide 12 is presented with conditions that cause the formation of solid phase crystals 62. The solid phase crystals 52 are blown forward by the propellant 14, where the combination of the carbon dioxide gas 12, carbon dioxide crystals 62 and propellant 14 can be used to clean a surface.

Figure 6:
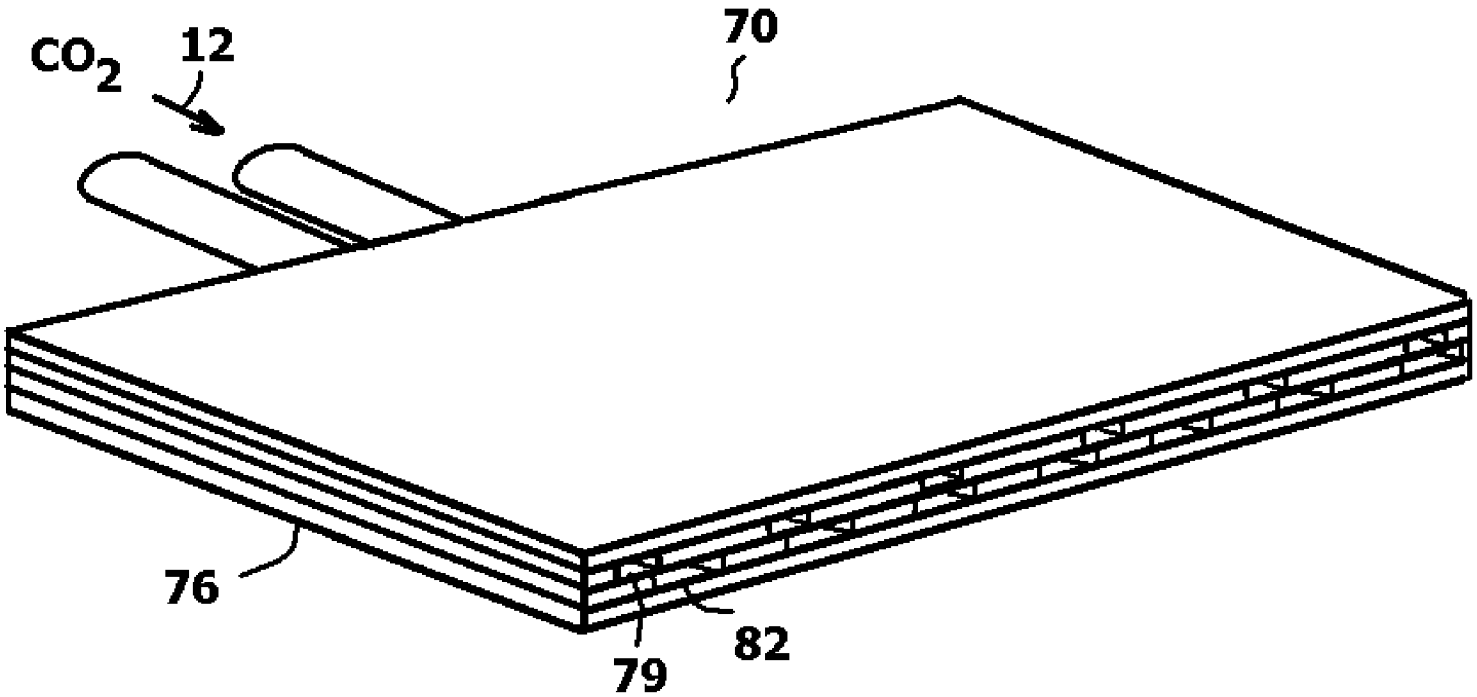
FIG. 6 show an alternate exemplary embodiment of a dispensing head.
Figure 7:
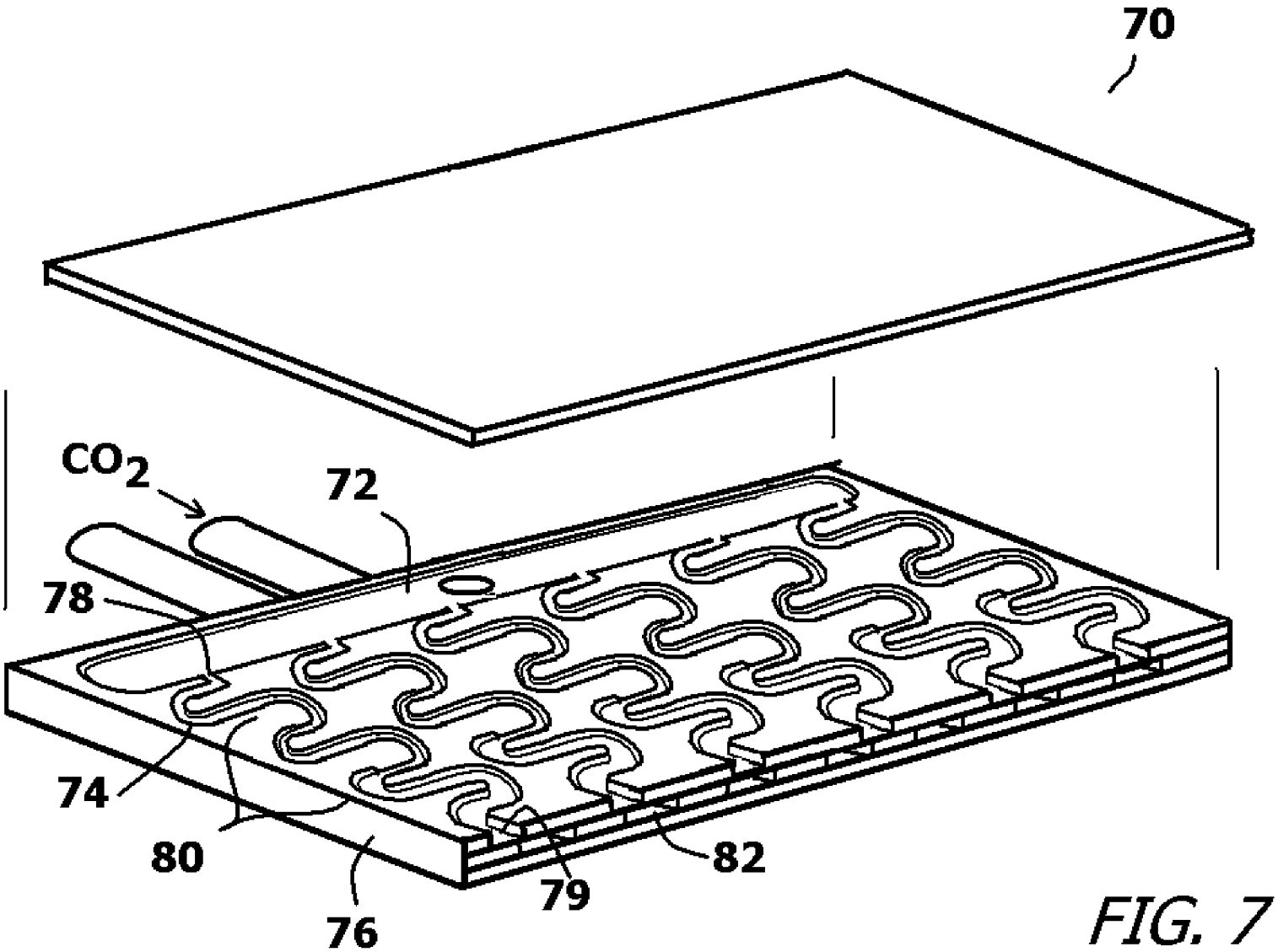
FIG. 7 shows a partially exploded view of the dispensing head of FIG. 6.

It will be understood that the dispensing head 30 of the present invention cleaning system 10 can have many shapes and configurations depending upon the product or material being cleaned. Further still, the number of output nozzles 36 is also a matter of design choice. Furthermore, the capillary tube assemblies 50 shown in the previous embodiment can be replaced with other shaped conduits that serve the same purpose. Such an alternate embodiment is shown in FIG. 6 and FIG. 7. In this embodiment of a dispensing head 70, no conduit tubes are used. This embodiment is useful in cleaning surfaces in confined areas where larger heads may be too large to reach confined areas in this embodiment, carbon dioxide 12 enters a $CO_2$ manifold chamber 72. The $CO_2$ manifold chamber 72 leads to a plurality of grooves 74 that are machined or etched into a plate 76 or gasket. The grooves 74 have the same length and same cross-sectional areas as the capillary tube assemblies previously described. As such, each groove 74 has a f rut end 78 and a second end 79, with a flow restriction area 80 extending part way between the first end 78 and the second end 79. The flow restriction area is just a section of the groove 74 where the size of the groove 74 is reduced. The grooves 74 can serpentine to reduce space requirements.

A similar second set of grooves 82 can be made for the propellant. The second end 79 of the grooves 74 for the carbon dioxide are in close proximity to the ends of the grooves 82 for the propellant so that the propellant can propel forward any crystals of solid phase carbon dioxide that exit the grooves 74.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A cleaning system, comprising:

a first supply of carbon dioxide;

a supply line for drawing said carbon dioxide from said first supply;

a second supply of propellant gas;

a dispending head that receives said carbon dioxide through said supply line and receives said propellant gas from said second supply, wherein said dispensing head contains a manifold chamber, multiple output nozzles, and multiple pathways that connect said manifold chamber to said output nozzles, wherein each of said multiple pathways extends a length between a first end and a second end, a flow restrictor disposed within each of said multiple pathways between said manifold chamber and said output nozzles, wherein each said flow restrictors is disposed a first distance from said first end that is between five percent and fifteen percent of said length, and wherein each said flow restrictor extends a second distance that is between one third and one half of said length, wherein said manifold chamber receives said carbon dioxide through said supply line and directs said carbon dioxide to said output nozzles through said multiple pathways.

2. The system according to claim 1, wherein each of said flow restrictors induces a formation of solid phase carbon dioxide crystals as said carbon dioxide flows through said multiple pathways.

3. The system according to claim 2, wherein said propellant gas accelerates said solid phase carbon dioxide crystals away from said dispensing head as said solid phase carbon dioxide crystals exit said multiple output nozzles.

4. The system according to claim 3, wherein said propellant gas is selected from a group consisting of compressed air, nitrogen, and noble gases.

5. The system according to claim 1, wherein said length of each of said multiple pathways is between five inches and twenty inches.

6. The system according to claim 1, wherein said supply line is a single supply line that connects said first supply to said manifold chamber in said dispensing head.

7. The system according to claim 1, further including an articulating arm for supporting said dispensing head and moving said dispensing head through a programed path of movement.

8. The system according to claim 1, further including a control unit for controlling flow of said carbon dioxide between said first supply and said dispensing head.

9. A dispensing head device for a system that cleans with carbon dioxide and a propellant, said device comprising:

a first manifold chamber that receives carbon dioxide therein, a plurality of output nozzles;

a plurality of pathways that extend from said first manifold chamber to said plurality of output nozzles, wherein each of said plurality of pathways has a length and an internal configuration along said length that induces a formation of solid phase carbon dioxide crystals as said carbon dioxide flows through said pathways;

wherein said internal configuration includes a flow restrictor that extends a distance that is between one third and one half of said length, and wherein said propellant accelerates said solid phase carbon dioxide crystals away from said dispensing head device.

10. The system according to claim 9, wherein said length of each of said plurality of pathways is between five inches and twenty inches.

11. The device according to claim 9, further including a second manifold chamber that receives said propellant.

12. The device according to claim 11, further including exit openings in said second manifold chamber that are equal in number to said plurality of output nozzles.

13. The device according to claim 12, wherein said exit openings and said plurality of output nozzles are concentric.

14. The device according to claim 9, wherein said propellant gas is selected from a group consisting of compressed air, nitrogen, and noble gases.

15. The device according to claim 9, wherein said plurality of pathways are tubes that extend from said first manifold chamber to said output nozzles.

* * * * *